US005711724A

United States Patent [19]

McGovern

[11] Patent Number: 5,711,724

[45] Date of Patent: Jan. 27, 1998

[54] BASEBALL BATTERS WARM-UP DEVICE

[76] Inventor: James Robert McGovern, 205 E. 239th St., Bronx, N.Y. 10470

[21] Appl. No.: 544,327

[22] Filed: Oct. 17, 1995

[51] Int. Cl.[6] ..... A63B 69/00

[52] U.S. Cl. ..... 473/427

[58] Field of Search ..... 473/427, 431, 473/436, 451, 453

[56] References Cited

U.S. PATENT DOCUMENTS

| | | | |
|---|---|---|---|
| 3,333,847 | 8/1967 | Pennington | 473/427 |
| 3,637,208 | 1/1972 | Allred | 473/427 |
| 4,872,675 | 10/1989 | Crowden | 473/427 |
| 5,275,396 | 1/1994 | Sudia | 473/427 |

*Primary Examiner*—Steven B. Wong

[57] ABSTRACT

A baseball batters warm-up device apparatus comprises a ball carried by an arm that is rotateable on a shaft that is supported to a stabelized vertical post, where the arm can be counter rotated by hand or by electric motor, against an elastic energizer line, into an arm holding electro magnetic switch so that when a batter extends his bat into his back-swing, the bat interrupts the beam of a passive infrared sensor, the sensor tripping the switch, & releasing said arm, so the batter can hit the ball and drive the arm back into said holding switch, only to be released again, and hit again, the back-swing, release, and hit sequence providing a rythmic warm-up exercise, and should the batter miss the ball, the arm is stopped and reset by hand, or the batter can step on home plate to actuate the motor to counter rotate the arm into the holding switch.

2 Claims, 4 Drawing Sheets

BASEBALL BATTERS WARM-UP DEVICE

BACKGROUND OF THE INVENTION

State of the art has for the most part provided batting devices that are directed to helping a young person learn the art of baseball hitting. One device provides means of learning how hard or how good a particular hit was by announcing an evaluation of the hit.

These devices are good and useful. The present invention however seeks to provide a device that could be used by experienced team players just before they step into the on-deck circle in a game to warm-up and heighten their preparation for their turn at bat.

BRIEF SUMMARY OF THE INVENTION

The present invention provides apparatus in a device used by a baseball batter to warm-up before coming to bat.

Each release of a rotatable arm which carries a ball through a batter's strike zone, is keyed to the back-swing of the batter. A batter steps on home plate to counter rotate the ball arm against an elastic line, and into an electro magnetic holding mechanism switch. A passive infrared sensor beam adjacent the batter is interrupted by the batter's bat as he reaches into his back-swing. The sensor triggers the holding switch and the elastic energized arm projects the ball into the strike zone. The batter hits the ball and drives the arm back into the holding mechanism.

The batter again instinctively reaches into a back-swing. A rhythmic sequence ensues . . . a back-swing, a release, a hit . . . a back-swing, a release, a hit. Should the batter experience difficulty driving the arm back into the holding mechanism, the switch, mounted on a rotatable platform, can be moved into a more easily reached position in support of the batters effort to maintain the rhythm sequence.

An arm travel limit mechanism stops the arm after a missed swing, and the batter resets the arm by again stepping on home plate. A hinged end piece of the arm is elevated to move the arm into the left hand batter mode. A three way switch is used to change the rotational direction of the motor shaft, required for the left hand batter mode.

A primary object of the invention is to provide a baseball batters warm-up device for use before the batter steps into the on-deck circle.

Another object of the invention is to provide apparatus where each release of a rotatable arm which carries a ball through the batters strike zone is triggered by the batters back swing.

Another object of the invention is to provide a home plate that when stepped on, will actuate a motor that will counter rotate the arm into a set energized position.

Another object of the invention is to provide an elastic arm energizing line that the arm is counter rotated against by the motor.

Another object of the invention is to provide an electro magnetic holding mechanism switch that the arm is counter rotated into, that holds the arm in an energized position.

Another object of the invention is to provide a passive infrared motion sensor, one for the right hand batting mode and one for the left hand batting mode, adjacent the batter, to detect the batters back-swing, and trigger the release of the ball arm.

Another object of the invention is to provide a rotateable holding mechanism platform, that is an adjustable mounting base for the switch, in order to improve the batters capability in his striving to achieve the rythmic sequence of back swing, release, and hit.

Another object of the invention is to provide a mechanism to stop the arm when the batter misses the ball so that the arm can be reset.

Another object of the invention is to provide a hinged section at the end of the ball arm so the arm can be moved past the arm limit mechanism, into the opposite hand batting mode.

And another object of the invention is to provide a three way switch in the inventions electrical circuit so the rotational direction of the motor shaft can be reversed when the batting mode is changed to the opposite hand batting mode.

SPECIFICATION

In order to construct a prototype, that is a working model of the new invention, "A BASEBALL BATTERS WARM-UP DEVICE", proceed as follows.

Figure 1:
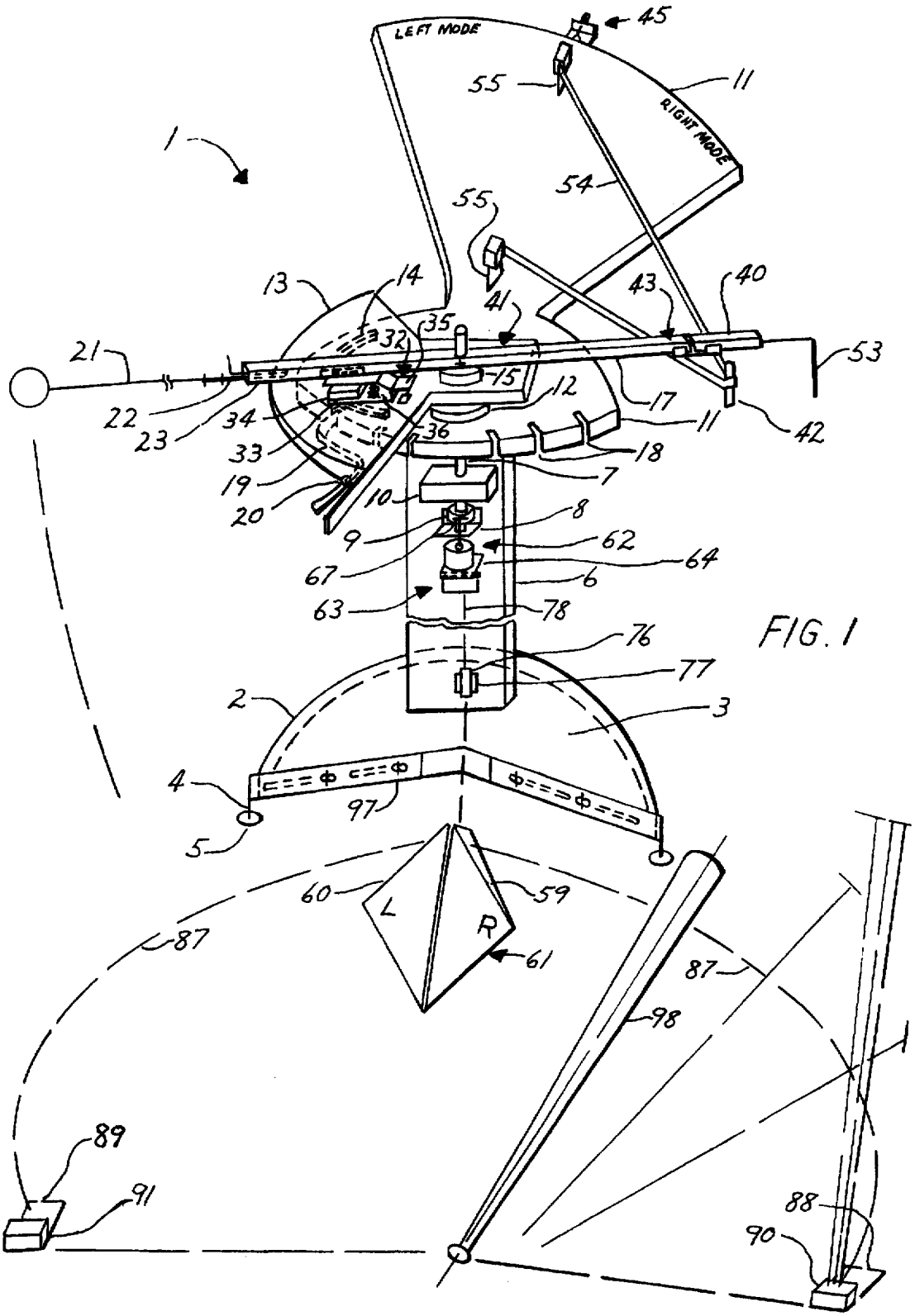
FIG. 1 is a perspective view of a baseball batters warm-up device that shows in simulation, a bat extended in back-swing, interrupting the beam from a passive infrared motion sensor.

Refer to FIG. 1 and provide the apparatus that a warm-up device for baseball batters 1 is comprised of.

Continuing, provide a device base 2 that resembles a pan 3, and that has three post type adjustable legs 4. Leg struts 97, held by wing nuts and bolts, are pulled out and secured, to increase base stability. Provide a flat disk foot 5 on each leg. An upright post 6 that supports an elongated ball arm shaft 7, is fastened to the top of the pan 3 by an L bracket that is not shown. A shaft supporting L bracket 8, that provides a cup like bearing surface on the top side of its horizontal leg is mounted on the face of post 6. A rubber coated pulley 9 is mounted on the shaft 7, spaced up from the shaft's lower end. A shaft 7 stabilizer block 10, is mounted on the face of the post 6, spaced up from bracket 8.

A platform 11, circular in shape, with an elongated shelf extending out of its rear half, is stationarily mounted on top of the post 6. The platform 11 is fastened by L bracket at the back of post 6. The bracket is not shown. A circular spacer 12 is stationarily fastened in the center of the circular shape of the base platform 11.

The shaft 7, disposed mounted on bracket 8's cup, extends upward through block 10, and spacer 12, and through a fan like platform 13. Platform 13 is carried rotatably on the top surface of spacer 12 and on a narrow ridge 14 that projects down from the underside surface of 13, and stabilizes 13 to the top surface of platform 11.

A circular spacer 15 is stationarily mounted on the top surface of platform 13. The shaft 7 extends through and above spacer 15.

An elongated ball arm base piece 17 is mounted on the top of the shaft 7 above arm spacer 15. The base piece of the arm 17 is stationarily secured to the shaft 7. A set screw through the side of the base piece 17, not shown, is set against a flat surface on the shaft 7, so that the shaft 7 turns with the arm base piece 17.

Six randomly spaced notches 18 are provided, cut in the outer edge of the base platform 11. One group of three notches 18, are cut in what would be identified as the right hand batters quadrant of the circular shape of the base platform 11. The other group of three notches 18, are cut within what would be identified as the left hand batters quadrant of the circular shape of base platform 11.

A mechanical retention lever 19 is attached to the right leading edge of switch platform 13. The lever 19 is under spring 20 tension. The lever is depressed so that switch platform 13 can be rotated and its location set when the lever engages the given notch 18 in the quadrant of the batters mode.

Figure 2:
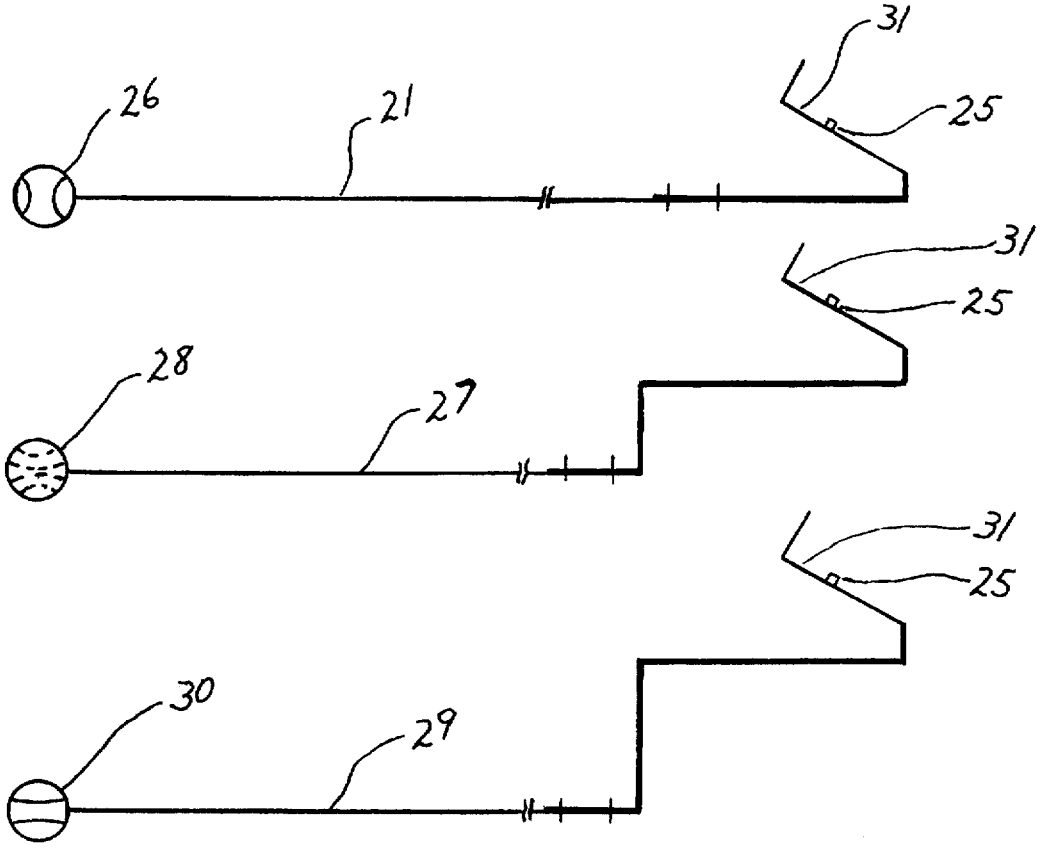
FIG. 2 is a side view of three embodiments of a ball, rod, and adapter, that is carried by the ball arm.
Figure 3:
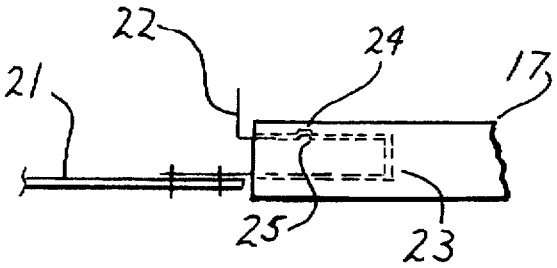
FIG. 3 is an enlarged side view of a ball rod adapter that has been fit into a hole in the end of the ball arm.

Continue reference to FIG. 1, and also refer to FIG. 2, and FIG. 3. A straight rod 21 is fitted with an adapter 22 that is attached to one end of the rod. The adapter 22 fits into an elongated hole 23 in the end of the ball arm base piece 17. A shallow hole 24 is provided, perpendicular to the adapter hole 23. A raised surface 25 on the adapter 22 fits into the shallow hole 24, to lock the rod 21 into place.

In the embodiment shown here, straight rod 21 provides the highest ball flight plane, and is suggested for use by an adult batter. It is suggested that rod 21 be fitted with a ball 26 that is similar in composition to a standard hard ball. Rod 27, with a slight offset, provides a lower ball flight plane and is suggested for use by pre and early teen batters. A rubber composition type ball 28 could be fitted to rod 27.

Rod 29, with a large offset, provides the lowest ball flight plane and is suggested for use by short pre teen and beginning batters. Rod 29 could be fitted with a hollow plastic or styrofoam type ball 30.

It should be noted that the ball flight plane is the circular horizontal line that the ball follows as it passes through a batters strike zone. The height of the plane is the vertical distance from the ground to the horizontal line. Also note that a rod and ball are changed by depressing the adapter extension 31, and pulling the adapter out of the ball arm base piece 17.

Figure 4:
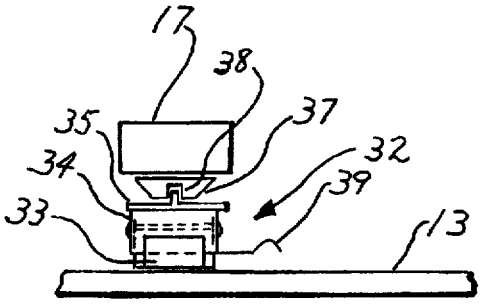
FIG. 4 is a frontal elevation of the electro magnetic ball arm holding mechanism switch.

With continued reference to FIG. 1, and also with reference to FIG. 4, mount electro magnetic switch 32 on the top surface of the movable fan shaped platform 13. The switch 32 comprises a base plate 33, an electro magnet 34, a hinged pan lever 35, a tension spring 36, a vertical pan blade 37, a grooved blade receptical 38, a switch mechanical release lever 39, and provision for two sets of + and – contact points, not shown. The grooved blade receptical 38 is fastened to the underside of the ball arm base piece 17. The pan blade 37 snaps into the grooved blade receptical 38 when the ball arm base piece 17 passes over it. The arm is held in set position. A release lever 39 can be lifted to release the electro magnetic switch 32 from its hold position.

Figure 5:
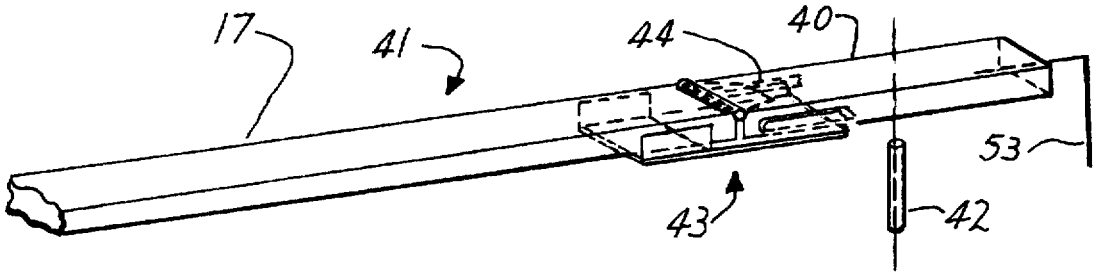
FIG. 5 is a perspective view of the bracket/clasp that is used in fastening the short extension piece to the end of the ball arm.

Again referring to FIG. 1, and also referring to FIG. 5, a short extension piece 40 is attached opposite the rod and ball end of piece 17. A ball, a rod, an adapter, a base arm piece, and a short extension piece variously comprise what is identified as the ball arm 41. A spool is carried on a post to provide a spindle like deflector apparatus 42 that is set in the extension 40, spaced from the attached end of 40. The spool of apparatus 42 extends down from the underside of piece 40. A bracket/clasp connector 43, which is an elongated plate with spring like vertically projecting sides at one end, joins piece 40 to piece 17.

Piece 17 is set on and fastened to the open end of the connectors plate. Piece 40 is stabilized and held by the clasping sides of the connector. Piece 40 is also fastened to a flap 44 that is hinged on a raised vertical rib located in the center of the plate.

Figure 6:
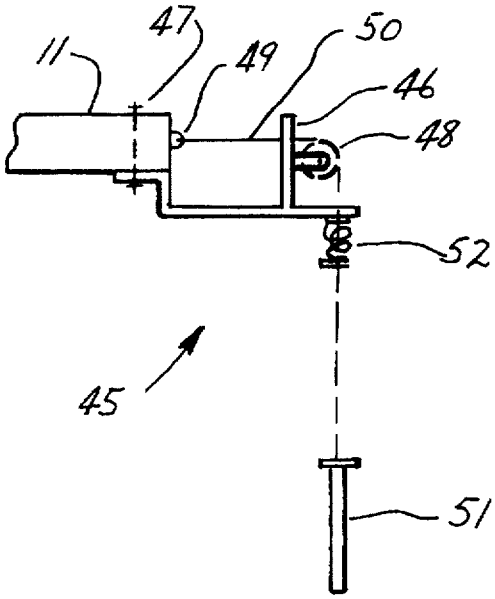
FIG. 6 is an elevation view of the ball arm travel limit mechanism.

A ball arm 41 travel limit mechanism 45 is provided, attached to the outer bottom edge of platform 11's leaf extension. See FIG. 6.

Mechanism 45 is comprised of a bracket 46, fastening bolts 47, a line diverting pulley 48, a U shaped line anchor 49, a line 50, a line counter weight 51, and a line recoil spring 52. An L shaped lever 53 which is set in the end of short piece 40 and which points toward the ground, encounters the line 50 of the arm travel limit mechanism 45, should the batter miss hitting a passing ball.

Figure 7:
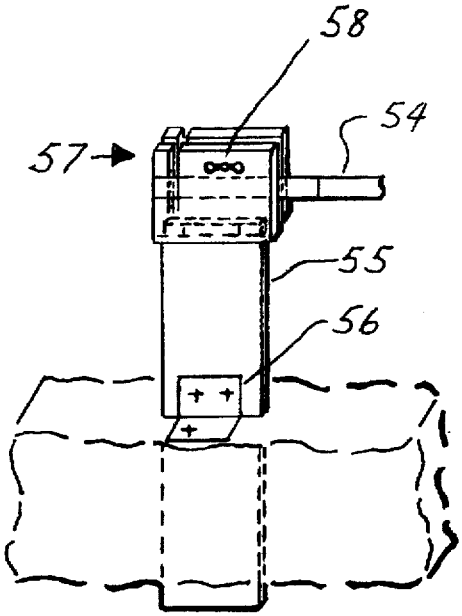
FIG. 7 is a perspective view of a ball arm elastic energizer anchor post and clamp.

Referring to FIG. 1 and to FIG. 7, an elastic ball arm energizer 54, which is used to rotate the ball arm 41 through the batters strike zone, is suspended between two anchor posts 55. The posts 55 are set, spaced apart, in the leaf of platform 11. Each post is supported to the leaf by a through bolted bracket 56. Each post 55 has a slotted 2 piece flexible clamp 57 fastened to its top. The energizer elastic 54 is laced through, around the outer end, and back through the clamp 57 as shown in FIG. 7. The pieces of the clamp are drawn together on the elastic 54 by tightening a butterfly nut-on-through bolt fastener 58. The energizer elastic 54 should be suspended in a non sagging but not taunt condition.

Figure 8:
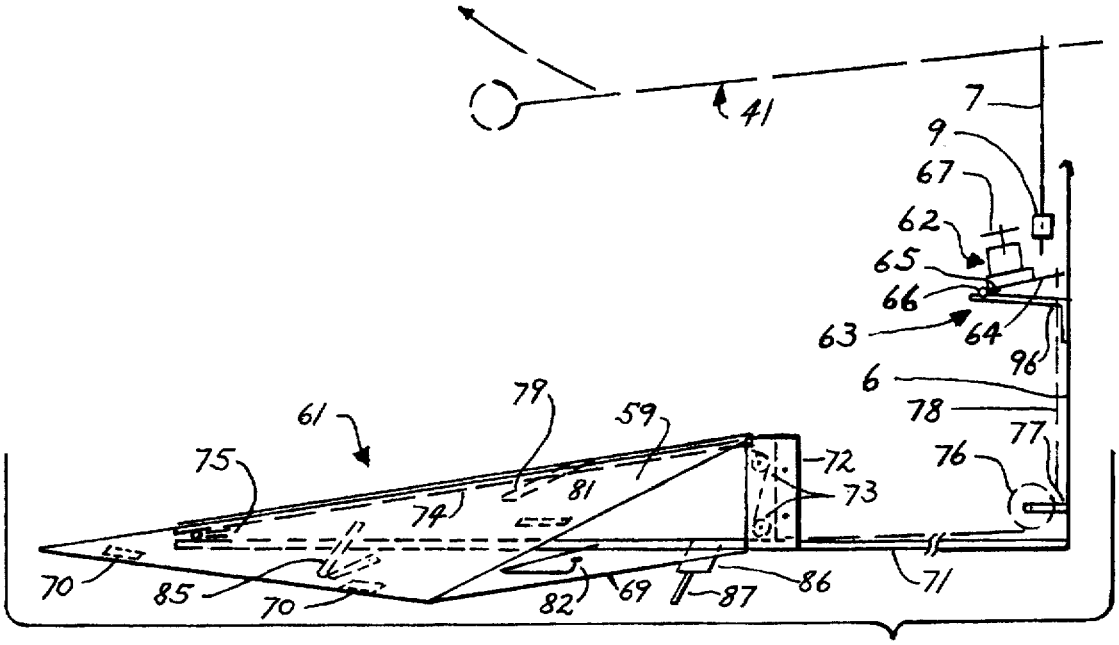
FIG. 8 is a schematic side elevation showing the right side of the home plate assembly.

Referring to FIG. 1, and to FIG. 8, provide apparatus that allows the batter to depress a panel, 59, or 60, on home plate 61, to tilt and turn on an electric motor 62 that is used to rotate the ball arm 41 back into a reset position when the batter swings and misses the ball.

Motor 62 bracket 63 has a motor base plate 64 hinged to the extended end of its horizontal leg. The vertical leg of bracket 63 is fastened to the face of post 6. Tension spring 65, wrapped around bracket hinge pin 66, provides upward pressure on the motor base 64. The motor shaft carries a rubber enclosed wheel 67. The motor 62 is disposed at an angle, its shaft wheel 67 spaced out of contact with the ball arm shaft 7 rubber tired pulley mounted on the lower end of shaft 7.

Home plate 61 panels, right side 59 marked R, and left side 60 marked L, are hinge 70 fastened on home plate base piece 69. A home plate stabilizing strut 71 is fastened to the center top side of base piece 69. Two parallel vertical pieces 72 are fastened spaced apart by the strut, to the strut 71. Two, small, line diverting pulley's 73, are mounted in near vertical alignment between the pieces 72.

An inclined home plate panel lever 74 is fastened by hinge 75 to the batter end of strut 71. The other end of strut 71 fits between, and can travel downward, guided by the slot formed by the paralell pieces. A single, larger, line diverting pulley 76, is mounted by bracket 77 on the face of post 6, just above pan 3. A line 78, which could be made of nylon, is connected by one of its ends, to motor base 64, and by its other end to the elevated end of the inclined lever 74. A lever diverting bar 79, is fastened to the underside of panel 59. The bar 79 projects beyond the edge of the panel, and just spans the width of the lever 74.

In similar fashion, bar 80 not shown is fastened to the underside of panel 60. Provide access hole 96 for the line 78, through bracket 63. Bar 80 projects beyond the edge of the panel, and just spans the width of lever 74. Bars 79 and 80 are spaced apart from each other in their attachment to the panels.

Home plate flexible+contact 81 is fastened on the underside of panel 59. Home plate flexible–contact 82 is fastened on the top surface of home plate base piece 69, beneath and in line with contact 81. Home plate flexible+contact 83 is fastened on the underside of panel 60. (not shown) Home plate flexible–contact 84 is fastened on the top surface of home plate base piece 69, beneath and in line with contact 83. (not shown)

Beneath each home plate panel, 59, and 60, an inclined flat metal spring 85 is mounted on home plate base piece 69. Each of these springs provides upward pressure on the panel above it. A conduit bracket 86 is fastened to the home plate stabilizer strut 71, one on each side of the strut. A light weight semi flexible conduit 87 is provided for device wiring, from bracket 86 to infrared sensor base 88 on the right hand batters side of home plate 61, and from the other 86 to infrared sensor base 89 on the left hand batters side of home plate 61. This is shown in simulated form in FIG. 1. The simulated motion of bat 98 is also shown.

A passive DA-1 narrow beam infrared motion sensor is mounted on each sensor base. Sensor 90 on base 88 and sensor 91 on base 89. The DA-1 sensor is commercially available from Visonic Ltd., Bloomfield, Conn.

Clamp 92 is provided for fastening conduit to bracket 86 and to the sensor bases 88 and 89. (not shown) The conduit lends a flexible stability to the positioning of the sensors in their required variable alignment with the batters stance and back-swing.

Figure 9:
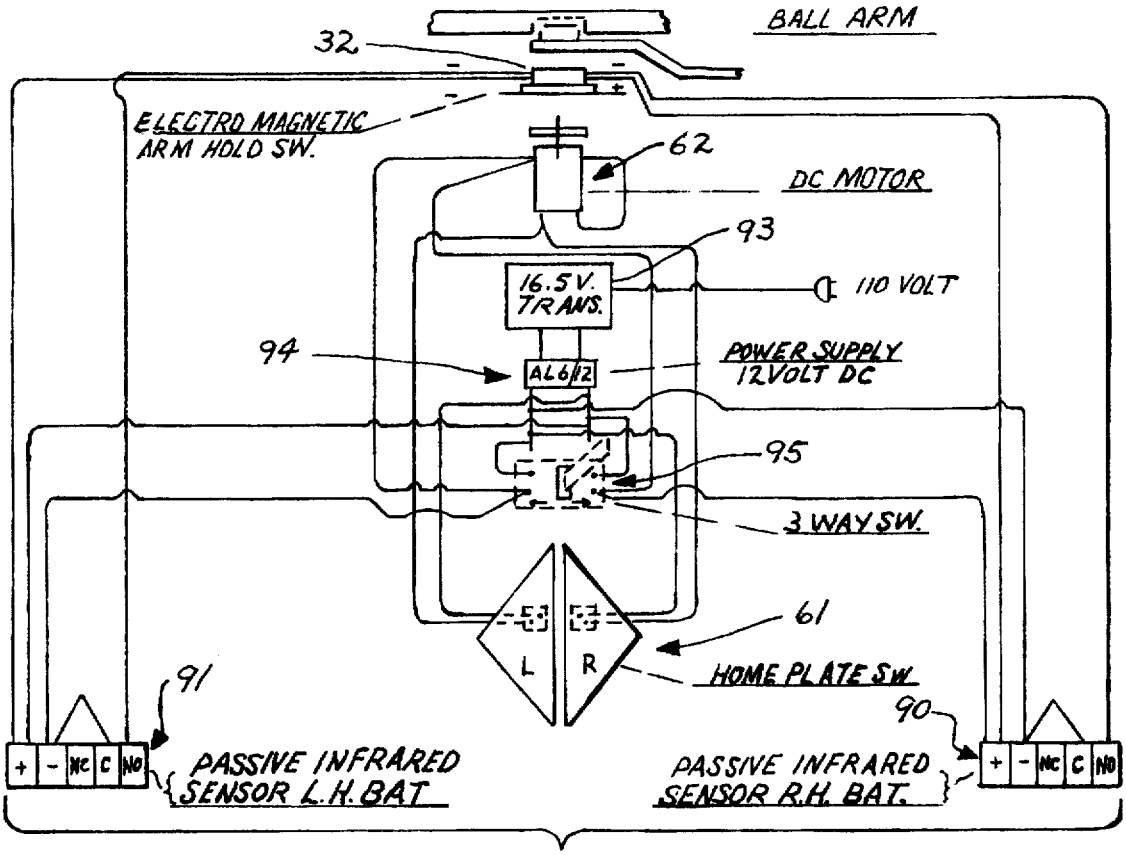
FIG. 9 is a conceptual plan view of the inventions electrical circuit.

With reference to the schematic portrayal of the electrical circuit specified for the embodiment of the invention shown in FIG. 9, note that the device is powered by 110 volt AC. An alternate embodiment of the invention could be powered by a 12 volt battery. In the embodiment portrayed/a 16.5 volt transformer 93, on the 110 volt line, is connected to an "AL 9/12 Power Supply/Charger" 94, commercially available from Altronix Corp., Bklyn., N.Y.

The power supply provides 12 volt DC current to, a 3 position on/off switch 95, the ball arm reset DC motor 62, and the two passive infrared motion sensors 90 and 91. The 3 position on/off switch 95 provides, current off when switch is in the center position, counter clockwise rotation of the motor shaft wheel 67 to reset the ball arm 41 for the right hand batter when the switch is in the left side position, and clockwise rotation of the motor shaft wheel 67 to reset the ball arm 41 for the left hand batter when the switch is in the right side position.

The reverse rotation of the motor wheel 67 is achieved by use of the 3 way switch to reverse the connection of the motor to the 12 volt DC power supply.

What is claimed is:

1. A baseball batters warm-up device comprising:

baseball batting means consisting of a baseball bat, device structural element means including, a pan like ballast holding base, set on flat disks that are screw adjustable to provide device leveling, a vertical post supported to the base, a circular platform supported to the post and having an elongated shelf, extending out from its rear quadrant, said platforms remaining quadrants leading edge containing several equally spaced vertical notches, a rotatable platform, fan like in shape, that carries an electro-magnetic arm holding mechanism switch on its top surface, where said platform carries a hand operated, spring loaded, platform position retension lever that pivots on a bracket fastened to the platform outer edge, so that the batter can manually set the location of the arm holding switch platform by depressing said lever and resetting its end into a selected notch, device structural element spacing means including, a circular spacer disk disposed between said circular platform, and said fan like shaped platform, and a circular spacer disk disposed above said fan like shaped platform, ball arm means including, a base arm piece that is fastened stationarily to said shaft by set screw, a short hinged end piece, that is fastened to one end of the base piece by a bracket that provides a hinge and a clasp, and a flexible rod that carries a ball at one end, and a spring adapter at its opposite end, where said hinged end piece can be elevated manually on its hinge to a near verticle attitude, and when returned to the horizontal, snapping into and being gripped by the spring like vertical sides of said clasp, stabilized on said bracket's horizontal member as a lengthwise continuation of said base piece, ball arm energizing means including, an elastic line that is carried, strung between two line posts that are spaced apart and set vertically in the top surface of the circular platforms extension, an elastic line screw clamp, one carried at the top of each line post, and a vertical spindled line deflector post that is set in and projects downward from the bottom surface of said arm short end piece, so that when said arm is forceably counter rotated, and the deflector encounters the line, the line is stretched and generates a counter force that becomes resident and stored in the arm, as the counter rotation pushes the arm into said electro-magnetic holding switch, ball arm travel limit means including, a line, a pulley and line supporting bracket, a U type anchor bolt, a coil spring, a counterweight, and a ball arm line lever, where the line lever is set in and projects down from the end of the short end piece, the line is fastened by the U bolt to the outer edge of said shelf, then draped over the bracket supported pulley, through the spring, and holds the suspended counterweight, so that when the arm is released and the ball is projected through the batters strike zone, and the batter swings and misses, the line lever encounters said line and displaces the counterweight, possibly encounters the coil spring, and is slowed gradually, and stopped, ball arm resetting means including, a DC motor, a motor shaft rubber rimmed pulley, a bracket with a hinged motor base plate, a motor base plate tension spring, and a ball arm shaft rubber surfaced pulley where line pressure on the base plate tilts the motor and its pulley into contact with said shaft pulley, so the actuated motor will counter rotate the ball arm and its shaft into the elastic line, home plate double switch means including, a base piece that carries a strut that is fastened to the face of said post, a right hand switch foot pedal and a left hand switch foot pedal that are hinged to the outer edge of said base, a plate inclined lever, hinged to the end of said strut, and a line lever guide, comprised of two parallel vertical pieces, that support two small line diverting pulleys, a flat metal spring under each panel to provide upward pressure on the foot pedals, a pair of motor circuit electrical contacts, mounted between each panel and the plate base piece, a lever diverter bar fastened to the underside of each panel, a remote line diverting pulley and bracket that are fastened at the base, on the face of the post, and a nylon line that extends from the upper end of the hinged line lever, through the small diverter pulleys, behind the post base diverter pulley and is attached to the unfastened end of the motor bracket base plate, so that when said right hand batting mode foot panel is stepped on, the lever diverter bar catches the line lever, and in pushing it down, the nylon line is displaced, and the motor is tilted into contact with the arm shaft pulley, and when the right panel contacts make contact, the motor counter rotates the shaft and arm in a clockwise direction into the holding switch, thus energizing the arm and setting it, passive infrared motion sensing means including, two sensors, one with its beam adjacent the right hand batter, and able to be interrupted by the batters bat when he performs his back-swing, and another in like fashion, able to be interrupted by the left hand batters bat when he performs his back-swing, said sensors becoming operative in said device's circuit, individually, dependent upon the operation of said device's circuit, circuit means for said device including, wiring connecting, a 110 volt AC line, to a 16.5 volt transformer, to an AL 6/12 power supply, to a three way switch, to a home plate douuble switch, and to a 12 volt DC motor, where said three way switch in one position provides power from the AL 6/12 to a right hand batter passive infrared motion sensor, and to the right side of said double switch, and in the other position provides power from the AL 6/12 to a left hand batter passive infrared motion sensor, and to the left side of said double switch, so that said arm holding magnetic switch is activated to release said ball arm, on the side of home plate that the three way switch has been positioned in, and where said motor is actuated and oriented by the batter when he steps on the right side panel of said home plate to reset said ball arm for a right hand batter, and where said motor is actuated and oriented by the batter when he steps on the left side panel of said home plate, to reset said ball arm for a left hand batter.

2. The apparatus of claim 1 wherein said hinged short end piece and said three way switch are used to change the device from the right hand batting mode to the left hand batting mode, said end piece being elevated, and the arm being moved manually to the left hand batting mode side of the travel limit line, and said three way switch being moved to the left side position, to reverse the rotation of the arm resetting DC motor.

* * * * *